US005572863A

United States Patent [19]

Wrightham et al.

[11] Patent Number: 5,572,863

[45] Date of Patent: Nov. 12, 1996

[54] RESILIENT ANNULAR MOUNTING MEMBER FOR A TRANSITION DUCT OF A COMBUSTION CHAMBER

[75] Inventors: David W. Wrightham, Leicestershire; David Pritchard, Coventry, both of England

[73] Assignee: Rolls-Royce plc, London, England

[21] Appl. No.: 493,141

[22] Filed: Jun. 21, 1995

[30] Foreign Application Priority Data

Sep. 15, 1994 [GB] United Kingdom ..... 9418576

[51] Int. Cl.[6] ..... F02C 3/00

[52] U.S. Cl. ..... 60/39.37; 60/39.32

[58] Field of Search ..... 60/39.31, 39.32, 60/39.36, 39.37, 39.75, 752

[56] References Cited

U.S. PATENT DOCUMENTS

| | | | |
|---|---|---|---|
| 2,578,481 | 12/1951 | Lombard | 60/39.37 |
| 2,592,060 | 4/1952 | Oulianoff | 60/39.32 |
| 2,608,057 | 8/1952 | Boyd et al. | 60/39.37 |
| 2,615,300 | 10/1952 | Lombard | 60/39.32 |
| 2,709,338 | 5/1955 | Morley et al. | 60/39.32 |
| 4,016,718 | 4/1977 | Lauck | 60/39.32 |
| 4,232,527 | 11/1980 | Redier | 60/754 |
| 5,085,038 | 2/1992 | Todman et al. | 60/39.37 |
| 5,353,586 | 10/1994 | Taylor et al. | 60/39.37 |
| 5,419,114 | 5/1995 | Bauermeister et al. | 60/39.32 |
| 5,428,952 | 7/1995 | Jewess | 60/39.31 |

FOREIGN PATENT DOCUMENTS

| | | | |
|---|---|---|---|
| 2531328 | 1/1977 | Germany | 60/39.37 |
| 579416 | 8/1946 | United Kingdom | 60/39.32 |
| 2087536 | 5/1982 | United Kingdom . | |
| 2247521 | 3/1992 | United Kingdom . | |

*Primary Examiner*—Timothy Thorpe
*Assistant Examiner*—Ted Kim
*Attorney, Agent, or Firm*—Cushman Darby & Cushman, L.L.P.

[57] ABSTRACT

A combustion chamber assembly comprises a plurality of tubular combustion chambers which have their axes arranged generally radially. A transition duct is provided for each of the tubular combustion chambers. Each transition duct has a circular upstream end arranged coaxially with the downstream end of the respective tubular combustion chamber. An annular resilient member mounts the upstream end of the respective transition duct on a tubular portion of a respective support structure. The inner end of the annular member is formed integrally with the upstream end of the transition duct and the outer end of the annular member is secured to a flange on the tubular portion of the support structure by a bolted connection. The annular member has a plurality of circumferentially extending slots to allow thermally induced articulation and to maintain the upstream end of the transition duct coaxial with the support member.

18 Claims, 3 Drawing Sheets

RESILIENT ANNULAR MOUNTING MEMBER FOR A TRANSITION DUCT OF A COMBUSTION CHAMBER

FIELD OF THE INVENTION

The present invention relates to a combustion chamber assembly, in particular to a combustion chamber assembly for a gas turbine engine.

In order to meet the emission level requirements for industrial low emission gas turbine engines, the combustion chamber volume has been increased. Currently many of the industrial gas turbine engines use annular or can-annular combustion chambers in an axial flow gas turbine engine. The requirement to increase the volume of the combustion chamber assembly whilst incorporating the combustion chamber assembly in the same axial length has necessitated the use of a plurality of tubular combustion chambers, whose longitudinal axes are arranged in a generally radial direction. The upstream, or inlet, ends of the tubular combustion chambers are at the radially outer end, and transition ducts connect the downstream, or outlet, ends of the tubular combustion chambers with the nozzle guide vanes to discharge the hot combustion gases axially into the turbine section of the gas turbine engine.

In operation the thermal movements of the nozzle guide vanes relative to the annular combustion chamber currently used, is mainly axial and is therefore easily accommodated.

In the combustion chamber assembly with tubular combustion chambers arranged with their axes extending generally radially, the relative thermal movements are more difficult to accommodate. These relative thermal movements are caused by the downstream end of the transition duct moving radially outwardly by more than the upstream end of the transition duct during starting for example. Also there is a problem of fretting at the upstream end of the transition ducts due to vibrations, or oscillations, of the transition duct induced by the noise generated by the gas turbine engine.

It has been proposed to minimise the fretting problem by minimising the noise signature of the source of excitation producing the fretting. It has also been suggested that tighter fits are used between components to restrict the movement which causes the fretting. Also it has been suggested to increase the contact areas where fretting occurs. It has also been proposed to apply wear wear resistant coatings to the contact areas where fretting occurs. It has also been proposed to combine two or more of these solutions. However, these proposed solutions have not satisfactorily overcome the problem.

Therefore it is necessary to provide a combustion chamber assembly which prevents fretting while at the same time allowing movement of the transition duct.

SUMMARY OF THE INVENTION

The present invention seeks to provide a novel combustion chamber assembly which overcomes the above mentioned problem.

Accordingly the present invention provides a combustion chamber assembly comprising at least one tubular combustion chamber having an upstream end and a downstream end, the upstream end of the tubular combustion chamber having means to introduce fuel and air into the tubular combustion chamber, a transition duct having an upstream end and a downstream end, the upstream end of the transition duct having a generally circular cross-section, the upstream end of the transition duct being arranged coaxially with the downstream end of the tubular combustion chamber, means to mount the upstream end of the transition duct on a support structure, the mounting means comprising an annular resilient member secured at its inner diameter to the upstream end of the transition duct and secured at its outer diameter to the support structure to restrict relative movement in radial directions between the transition duct and the support member, the annular resilient member having at least two circumferentially extending slots to allow thermally induced articulation between the upstream end of the transition duct and the support structure.

Preferably the combustion chamber assembly comprises a plurality of equally circumferentially spaced tubular combustion chambers, each tubular combustion chamber has an upstream end and a downstream end, the upstream end of each tubular combustion chamber has means to introduce fuel and air into the respective tubular combustion chamber, a plurality of equally circumferentially spaced transition ducts, each transition duct has an upstream end and a downstream end, the upstream end of each transition duct has a generally circular cross-section, the upstream end of each transition duct is arranged coaxially with the downstream end of a respective one of the plurality of tubular combustion chambers, a plurality of equally circumferentially spaced mounting means, each mounting means mounts the upstream end of a respective one of the plurality of transition ducts in a respective one of the plurality of support structures, each mounting means comprises an annular resilient member secured at its inner diameter to the upstream end of the respective transition duct and secured at its outer diameter to the respective support structure, each annular resilient member has at least two circumferentially extending slots.

Preferably each annular resilient member has six circumferentially extending slots.

Preferably each support structure comprises a tubular portion, the downstream end of each tubular combustion chamber is slidably mounted in the tubular portion of the respective support structure, the upstream end of each transition duct is slidably mounted in the tubular portion of the respective support structure downstream of the downstream end of the respective tubular combustion chamber.

Preferably the downstream end of each tubular combustion chamber has a portion of reduced diameter at its most downstream end to allow relative sliding movement between the downstream end of the tubular combustion chamber and the upstream end of the respective transition duct to permit the downstream end of the tubular combustion chamber to move into the upstream end of the respective transition duct.

Preferably each support structure further comprises at least one X-shaped support member and a ring, one end of the X-shaped support member is secured to the tubular portion and the other end of the X-shaped support member is secured to the ring.

Preferably each support structure comprises six X-shaped support members, one end of each X-shaped support member is secured to the tubular portion and the other end of each X-shaped support member is secured to the ring.

Preferably each ring-is secured to a combustion chamber casing, the combustion chamber casing surrounds the tubular combustion chamber.

Preferably each annular resilient member is integral with or welded to the upstream end of the respective transition duct.

Preferably each annular resilient member is secured to the respective support structure by nut and bolt joints.

Preferably the ends of each circumferentially extending slot have enlarged circular portions to minimise stress concentrations at the ends of the slot.

Preferably the axes of the tubular combustion chambers are arranged generally in a radial direction, the downstream end of each transition duct is arranged in operation to discharge combustion gases in an axial direction.

Preferably each nut and bolt joint is arranged substantially in the same radial plane as the circumferential centre of a respective one of the circumferentially extending slots.

Preferably the outer diameter of the annular resilient member is secured to the support structure at locations between the ends of each of the at least two slots and radially outward from the at least two slots.

Preferably the outer diameter of the annular resilient member is secured to the support structure at locations midway between the ends of each of the at least two slots and radially outward from the at least two slots.

Preferably the outer diameter of the annular resilient member is secured to the support structure at a plurality of equally circumferentially spaced locations, each location is midway between the ends of one of the slots and radially outward from the respective slot.

The present invention also provides a combustion chamber assembly comprising a plurality of equally circumferentially spaced tubular combustion chambers, each tubular combustion chamber has an upstream end and a downstream end, the upstream end of each tubular combustion chamber has means to introduce fuel and air into the respective tubular combustion chamber, a plurality of equally circumferentially spaced transition ducts, each transition duct has an upstream end and a downstream end, the upstream end of each transition duct has a generally circular cross-section, the upstream end of each transition duct is arranged coaxially with the downstream end of a respective one of the plurality of tubular combustion chambers, a plurality of equally circumferentially spaced mounting means, each mounting means mounts the upstream end of a respective one of the plurality of transition ducts in a respective one of the plurality of support structures, each mounting means comprises an annular resilient member secured at its inner diameter to the upstream end of the respective transition duct and secured at its outer diameter to the respective support structure to restrict relative movement in radial directions between the transition duct and the support member, each annular resilient member has at least two circumferentially extending slots to allow thermally induced articulation between the upstream end of the transition duct and the support structure.

BRIEF DESCRIPTION OF THE DRAWINGS

The present invention will be more fully described by way of example with reference to the accompanying drawings, in which.

DETAILED DESCRIPTION OF THE INVENTION

Figure 1:
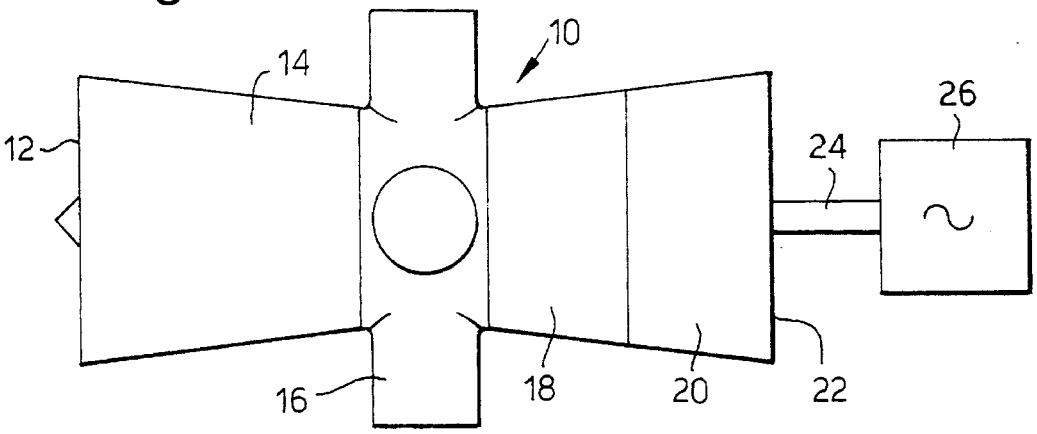
FIG. 1 is a view of a gas turbine engine having a combustion chamber assembly according to the present invention.
Figure 2:
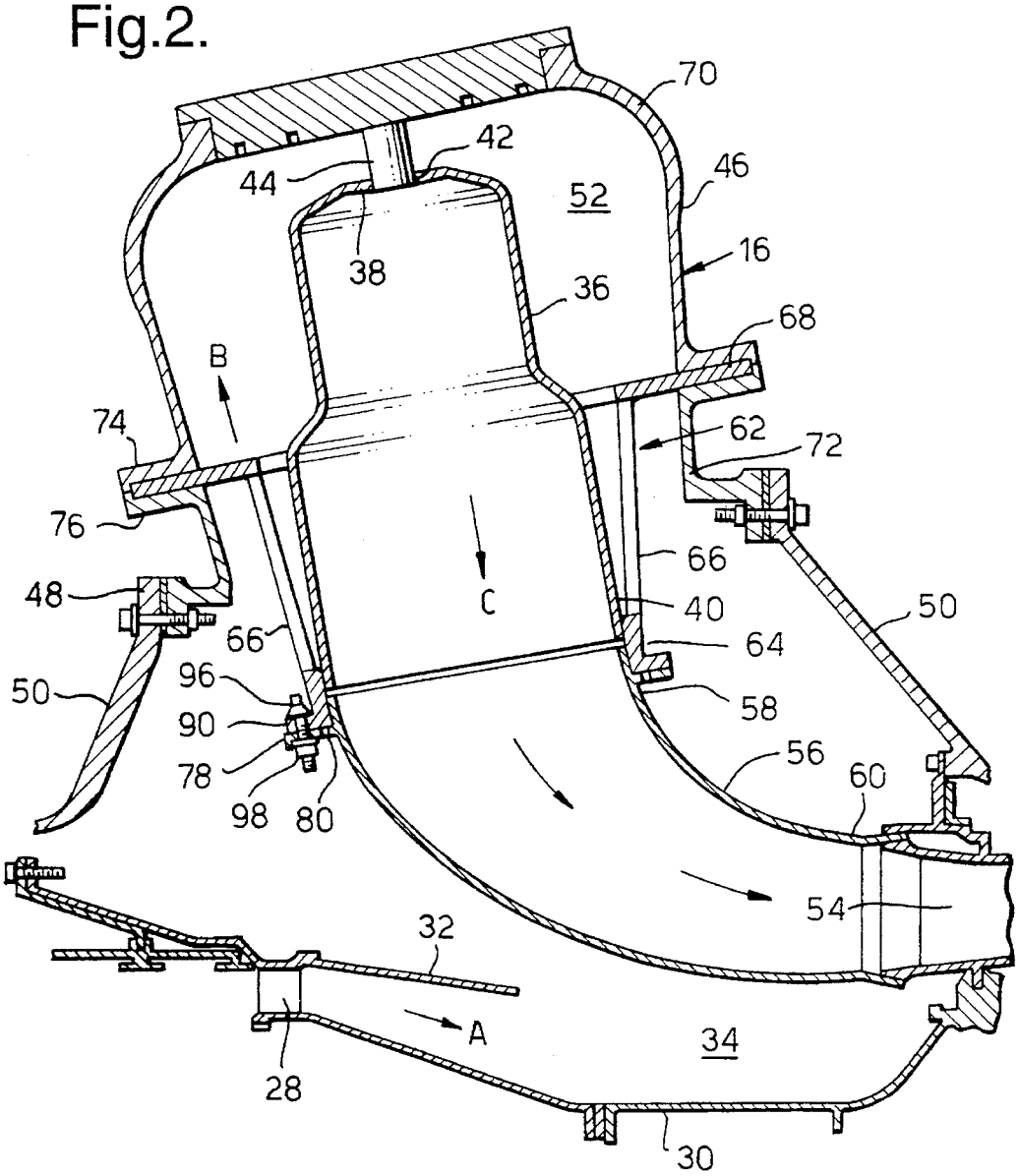
FIG. 2 is an enlarged longitudinal cross-sectional view through a combustion chamber assembly according to the present invention and part of the gas turbine engine shown in FIG. 1.
Figure 3:
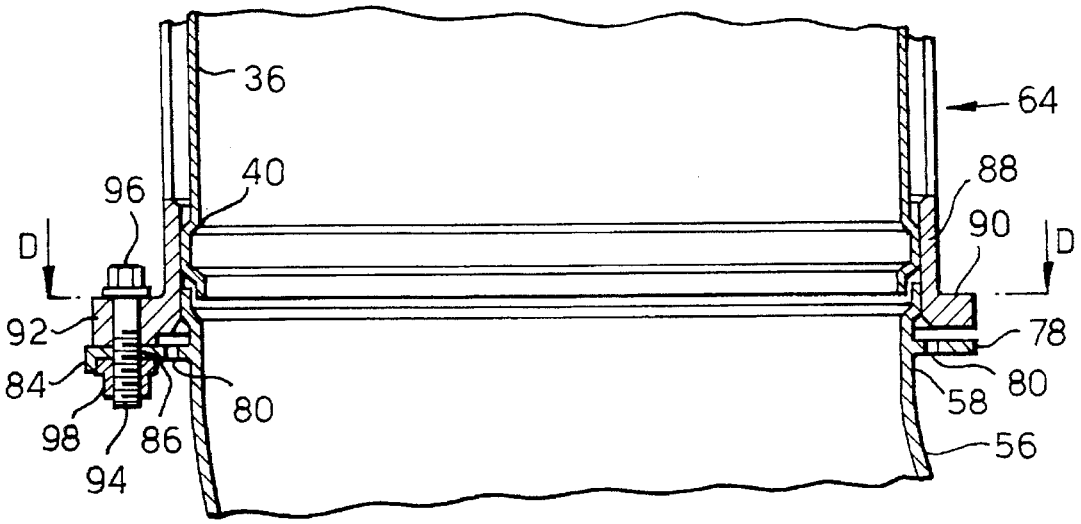
FIG. 3 is a further enlarged cross-sectional view through a portion of the combustion chamber assembly in FIG. 2.
Figure 4:
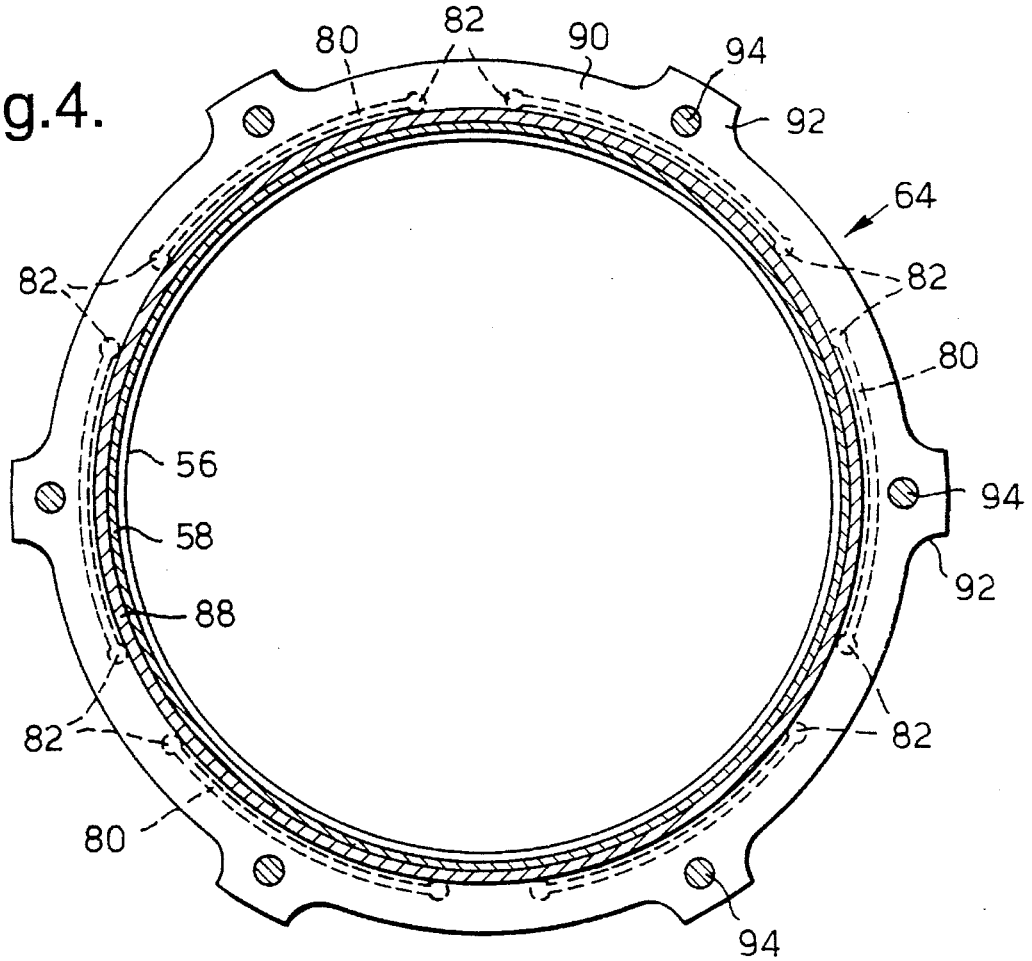
FIG. 4 is a view in the direction of arrows D—D in FIG. 3.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 18 is arranged to drive the compressor section 14, and the power turbine section 20 is arranged to drive an electrical generator 26, or a mechanical device, for example a pump or a ships propeller, via a shaft 24. The operation of the gas turbine engine 10 is quite conventional, and will not be discussed further.

The combustion chamber assembly 16 is shown more clearly in FIGS. 2 to 5. A plurality of compressor outlet guide vanes 28 are provided at the axially downstream end of the compressor section 14, to which is secured at their radially inner ends an inner annular wall 30 which defines the inner surface of an annular chamber 34. An annular wall 32 is secured to the radially outer ends of the compressor outlet guide vanes 28. The annular wall 32 and the upstream portion of the annular wall 30 define a diffuser. The downstream end of the inner annular wall 30 is secured to the radially inner ends of the nozzle guide vanes 54 which direct hot gases from the combustion chamber assembly 16 into the turbine section 18.

The combustion chamber assembly 16 comprises a plurality of equally circumferentially spaced tubular combustion chambers 36. The axes of the tubular combustion chambers 36 are arranged to extend in a generally radial direction, the upstream, inlet, ends 38 of the tubular combustion chambers 36 are arranged at their radially outermost ends and the downstream, outlet, ends 40 are arranged at their radially innermost ends. The upstream end of each of the tubular combustion chambers 36 has an inlet 42 for air and one or more fuel injectors 44. The air inlet 42 may have swirlers in order to impart a swirling motion to the air flowing into the combustion chamber 36 as shown in our International patent application No. WO92/07221 published on 30 Apr. 1992. A plurality of cylindrical casings 46 are provided, each cylindrical casing 46 is located coaxially around a respective one of the tubular combustion chambers 36, and each cylindrical casing 46 is secured to a respective boss 48 on an annular engine casing 50. A chamber 52 is formed between each tubular combustion chamber 36 and its respective cylindrical casing 46.

A plurality of equally circumferentially spaced transition ducts 56 are provided, and each of the transition ducts 56 has an upstream end 58 and a downstream end 60. The upstream end 59 has a circular cross-section. The upstream end 58 of each of the transition ducts 56 is arranged coaxially with the downstream end 40 of a respective one of the tubular combustion chambers 36, and the downstream end 60 of each of the transition ducts 56 connects and seals with an angular section of the nozzle guide vanes 54.

Figure 5:
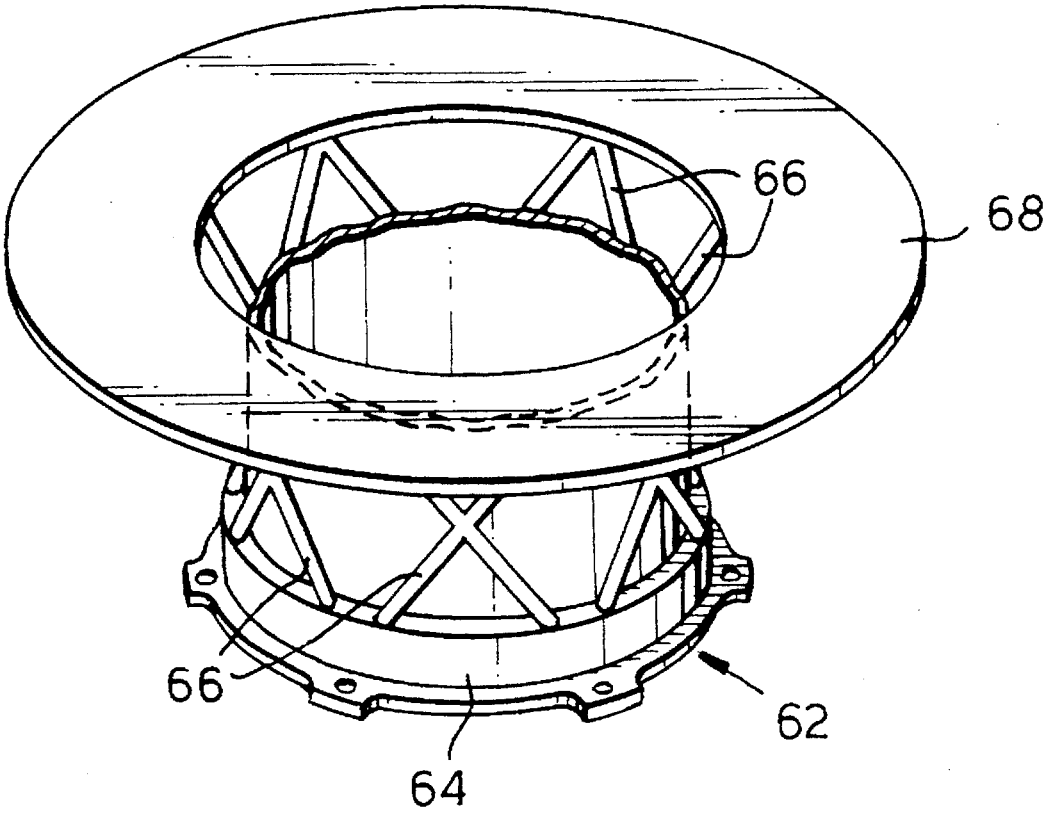
FIG. 5 is a perspective view of the support structure shown in FIG. 2.

A plurality of equally circumferentially spaced support structures 62 are provided, and each support structure 62 comprises a tubular portion 64, which has a circular bore therethrough, a plurality of, for example six, X-shaped support members 66 and a ring 68, shown more clearly in FIG. 5. The X-shaped support members 66 are secured at one end to the tubular portion 64 and at the other end to the ring 68. This forms a geodetic support structure and provides stiffness in three perpendicular axes.

The downstream end 40 of each of the tubular combustion chambers 36 is axially slidably mounted coaxially in the circular bore of a tubular portion 64 of a respective one of the support structures 62. Similarly the upstream end 58 of each of the transition ducts 56 is axially slidably mounted coaxially in the circular bore of a tubular portion 64 of a respective one of the support structures 62. Each of the rings 68 is trapped between flanges 74 and 76 of first and second parts 70 and 72 respectively of a respective cylindrical casing 46. The X-shaped support members 66 allow the flow of air from the chambers 34 to the chambers 52 and to the inlets 42 at the upstream ends 38 of the tubular combustion chambers 36. The X-shaped support members are arranged in a cone, for example at 15° to the axis of the tubular combustion chamber 36.

Alternatively any other suitable support structure may be used which provides stiffness in the three orthogonal axes, for example a conical support which is provided with apertures to allow the flow of air therethrough.

The upstream end 58 of each transition duct 56 is mounted onto the respective support structure 62 by a respective annular resilient member 78 which is in the form of an annular flange extending in a radial direction relative to the outer periphery of the transition duct 56. By "resilient" is meant flexible relative to the adjacent structure such as the tubular portion 64 of the assembly. Each annular resilient member 78 is formed integrally with, or is welded onto the upstream end 58 of the respective transition duct 56. Each annular resilient member 78 has a plurality of equally circumferentially spaced circumferentially extending slots 80, in this example six slots 80 are provided. The centres of the slots 80 are circumferentially spaced by 60°, and each slot 80 extends through approximately 50° of the full circumference of the annular resilient member 78. The ends 82 of each of the slots 80 are enlarged, and are circular, to minimise stress concentrations at the ends of the slots 80. Each of the annular resilient members 78 has a plurality of equally circumferentially spaced radial extensions 84, in this example six, through which apertures 86 are formed. The radial extensions 84 are generally arranged such that the centres of the slots 80 are in the same radial plane as the centres of the apertures 86.

The downstream end 88 of the tubular portion 64 of each support structure 62 has a flange 90. Each flange 90 has a plurality of radial extensions 92, in this example six, through which apertures 94 are formed. The flange 90 of the tubular portion 64 of each support structure 62 is secured to the annular resilient member 78, secured to a respective transition duct 56, by a plurality of bolts 96, which pass through the aperture 94 and 86 in the flange 90 and the annular resilient member 78 respectively, and by nuts 98 which are threaded onto the bolts 96.

The use of the annular resilient member 78 restricts the movement of the upstream end 58 of the transition duct 56 in all radial directions to prevent fretting. The circumferentially extending slots 80 allow the movement which is necessary to accommodate thermally induced articulation. The slots 80 also maintain the roundness of the upstream end 58 of the transition duct 56 by reducing the stresses which would otherwise be generated by the thermal gradients between the hot transition duct 56 and the less hot annular resilient member 78.

The extreme downstream end 98 of the tubular combustion chambers 36 has a region of reduced diameter so that the downstream end of the tubular combustion chamber 36 can slide axially into the upstream end 58 of the respective transition duct 56. It is equally possible to arrange the upstream end of the transition ducts 56 to have a region of reduced diameter so that the downstream ends of the tubular combustion chambers 36 can slide axially over the the upstream end of the respective transition duct 56.

The annular resilient member simultaneously constrains the transition duct to prevent fretting while allowing it to move in a controlled manner to accommodate transient movements. The annular resilient member allows considerable scope to tune the natural frequency of oscillation away from the frequencies of noise generated by the gas turbine engine which cause fretting. This can be achieved by varying the number of fixing bolts and nuts, varying the thickness of the annular resilient member, varying the inner and/or outer diameters of the annular resilient member and varying the width and/or length of the slots.

Thus the arrangement overcomes the problem of trying to provide a rigid connection between the support structure and the upstream end of the transition duct to prevent fretting while at the same time allowing articulation between the support structure and the upstream end of the transition duct to permit the relative thermal movements between the upstream and downstream ends of the transition duct. The thermally induced movements of the transition duct are due to the transient changes in temperature, for example during starting when the downstream end of the transition duct moves radially, with respect to the axis of the gas turbine engine, outwardly more than the upstream end of the transition duct and this leads to rotation of the transition duct.

There must be at least two circumferentially extending slots and preferably they are arranged equally circumferentially spaced, i.e. there centres are arranged 180° apart or diametrically opposite each other. In the case of three circumferentially extending slots, they are preferably equally circumferentially spaced, i.e. there centres are arranged 120° apart. Similarly four circumferentially extending slots would be arranged 90° apart.

We claim:

1. A combustion chamber assembly comprising at least one tubular combustion chamber having an axis and having an upstream end and a downstream end, the upstream end of the tubular combustion chamber having means to introduce fuel and air into the tubular combustion chamber, a transition duct having an upstream end and a downstream end, the upstream end of the transition duct having a generally circular cross-section, the upstream end of the transition duct being arranged coaxially with the downstream end of the tubular combustion chamber, means to mount the upstream end of the transition duct on a support structure, the mounting means comprising an annular resilient member having an inner diameter secured to the upstream end of the transition duct and having an outer diameter duct secured to the support structure to restrict relative movement in radial directions relative to the axis of said combustion chamber between the transition duct and the support member, the annular resilient member having at least two circumferentially extending slots with a length greater in the circumferential direction than the radial direction to allow thermally induced articulation between the upstream end of the transition duct and the support structure.

2. A combustion chamber assembly as claimed in claim 1 in which the combustion chamber assembly comprises a plurality of equally circumferentially spaced tubular combustion chambers, each tubular combustion chamber has an upstream end and a downstream end, the upstream end of each tubular combustion chamber has means to introduce fuel and air into the respective tubular combustion chamber, a plurality of equally circumferentially spaced transition ducts, each transition duct has an upstream end and a downstream end, the upstream end of each transition duct has a generally circular cross-section, the upstream end of each transition duct is arranged coaxially with the downstream end of a respective one of the plurality of tubular combustion chambers, a plurality of equally circumferentially spaced mounting means, each mounting means mounts the upstream end of a respective one of the plurality of transition ducts in a respective one of the plurality of support structures, each mounting means comprises an annular resilient member secured at its inner diameter to the upstream end of the respective transition duct and secured at its outer diameter to the respective support structure, each annular resilient member has at least two circumferentially extending slots.

3. A combustion chamber assembly as claimed in claim 2 in which the axes of the tubular combustion chambers are arranged generally in a radial direction relative to said axes of said tubular combustion chambers, the downstream end of each transition duct is arranged in operation to discharge combustion gases in an axial direction.

4. A combustion chamber assembly as claimed in claim 1 in which each annular resilient member has six circumferentially extending slots.

5. A combustion chamber assembly as claimed in claim 1 in which each support structure comprises a tubular portion, the downstream end of each tubular combustion chamber is slidably mounted in the tubular portion of the respective support structure, the upstream end of each transition duct is slidably mounted in the tubular portion of the respective support structure downstream of the downstream end of the respective tubular combustion chamber.

6. A combustion chamber assembly as claimed in claim 5 in which the downstream end of each tubular combustion chamber has a portion of reduced diameter at its most downstream end to allow relative sliding movement between the downstream end of the tubular combustion chamber and the upstream end of the respective transition duct to permit the downstream end of the tubular combustion chamber to move into the upstream end of the respective transition duct.

7. A combustion chamber assembly as claimed in claim 5 in which each support structure further comprises at least one X-shaped support member and a ring, one end of the X-shaped support member is secured to the tubular portion and the other end of the X-shaped support member is secured to the ring.

8. A combustion chamber assembly as claimed in claim 7 in which each support structure comprises six X-shaped support members, one end of each X-shaped support member is secured to the tubular portion and the other end of each X-shaped support member is secured to the ring.

9. A combustion chamber assembly as claimed in claim 7 in which each ring is secured to a combustion chamber casing, the combustion chamber casing surrounds the tubular combustion chamber.

10. A combustion chamber assembly as claimed in claim 1 in which each annular resilient member is integral with or welded to the upstream end of the respective transition duct.

11. A combustion chamber assembly as claimed in claim 1 in which each annular resilient member is secured to the respective support structure by nut and bolt joints.

12. A combustion chamber as claimed in claim 11 in which each nut and bolt joint is arranged substantially in the same radial plane as the circumferential centre of a respective one of the circumferentially extending slots.

13. A combustion chamber assembly as claimed in claim 1 in which the outer diameter of the annular resilient member is secured to the support structure at locations between the ends of each of the at least two slots and radially outward from the at least two slots.

14. A combustion chamber assembly as claimed in claim 13 in which the outer diameter of the annular resilient member is secured to the support structure at locations midway between the ends of each of the at least two slots and radially outward from the at least two slots.

15. A combustion chamber as claimed in claim 13 in which the outer diameter of the annular resilient member is secured to the support structure at a plurality of equally circumferentially spaced locations, each location is midway between the ends of one of the slots and radially outward from the respective slot.

16. A combustion chamber assembly as claimed in claim 1 in which the ends of each circumferentially extending slot have enlarged circular portions to minimise stress concentrations at the ends of the slot.

17. A combustion chamber assembly as claimed in claim 1 in which the slots are equally circumferentially spaced.

18. A combustion chamber assembly comprising a plurality of equally circumferentially spaced tubular combustion chambers, each tubular combustion chamber has an upstream end and a downstream end, the upstream end of each tubular combustion chamber has means to introduce fuel and air into the respective tubular combustion chamber, a plurality of equally circumferentially spaced transition ducts, each transition duct has an upstream end and a downstream end, the upstream end of each transition duct has a generally circular cross-section, the upstream end of each transition duct is arranged coaxially with the downstream end of a respective one of the plurality of tubular combustion chambers, a plurality of equally circumferentially spaced mounting means, each mounting means mounts the upstream end of a respective one of the plurality of transition ducts in a respective one of the plurality of support structures, each mounting means comprises an annular resilient member secured at its inner diameter to the upstream end of the respective transition duct and secured at its outer diameter to the respective support structure to restrict relative movement in radial directions between the transition duct and the support member, each annular resilient member has at least two circumferentially extending slots to allow thermally induced articulation between the upstream end of the transition duct and the support structure.

* * * * *